US007296328B1

(12) United States Patent
Petri et al.

(10) Patent No.: US 7,296,328 B1
(45) Date of Patent: Nov. 20, 2007

(54) APPARATUS AND METHOD FOR INCREASING THE AIR PERMEABILITY OF A TEXTILE WEB

(75) Inventors: Patrick A. Petri, Greer, SC (US); John A. Sollars, Jr., LaGrange, GA (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 11/477,039

(22) Filed: Jun. 28, 2006

(51) Int. Cl.
*D06C 29/00* (2006.01)
*D06C 19/00* (2006.01)

(52) U.S. Cl. ..... 26/27; 28/165

(58) Field of Classification Search ..... 26/27, 26/28, 25, 37, 51, 69 C, 71, 99, 100; 28/165, 28/162, 163
See application file for complete search history.

(56) References Cited

U.S. PATENT DOCUMENTS

| | | | | | |
|---|---|---|---|---|---|
| 162,440 | A * | 4/1875 | Webber | 26/28 |
| 301,413 | A * | 7/1884 | Walker | 26/15 R |
| 1,555,865 | A * | 10/1925 | McConnell | 26/27 |
| 1,917,555 | A * | 7/1933 | Shuttleworth | 26/2 R |
| 2,730,113 | A * | 1/1956 | Hadley | 26/25 |
| 3,137,054 | A * | 6/1964 | De Mestral | 26/28 |
| 3,592,732 | A * | 7/1971 | Wand | 26/27 |
| 4,631,788 | A * | 12/1986 | Dischler et al. | 26/25 |
| 4,769,879 | A | 9/1988 | Otto | 26/25 |
| 5,581,856 | A | 12/1996 | Krummheuer et al. | 26/18.5 |
| 5,966,785 | A | 10/1999 | Catallo | 26/27 |
| 6,195,854 | B1 | 3/2001 | Catallo | 26/27 |
| 2003/0154580 | A1* | 8/2003 | Overcash et al. | 26/27 |

* cited by examiner

*Primary Examiner*—Amy B. Vanatta
(74) *Attorney, Agent, or Firm*—Terry T. Moyer; Cheryl J. Brickey

(57) ABSTRACT

The invention relates to a treatment apparatus and process for increasing the air permeability of a textile web, and the airbag fabrics made by such process. The process includes passing the textile web across a first guide having a first guide surface directing the textile web to the treatment body, rotating a treatment body about a treatment body axis, and moving the textile web from the first guide surface in tension around a portion of the treatment body and in contact with the exterior surface of the treatment body, in a direction substantially perpendicular to the treatment body axis, wherein the exterior surface of the treatment body includes at least one longitudinal edge substantially parallel to the treatment body axis, passing the textile web across a second guide having a second guide surface directing the textile web from the treatment body, wherein the included angle between a first plane running from the first guide surface to the treatment body axis and a second plane running between the second guide surface and the treatment body axis is greater than zero degrees and less than about 160 degrees. The treatment apparatus to increase the air permeability is also disclosed.

40 Claims, 7 Drawing Sheets

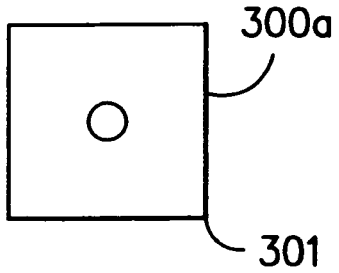
FIG. –3A–
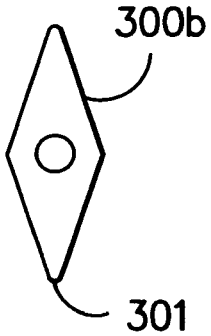
FIG. –3B–
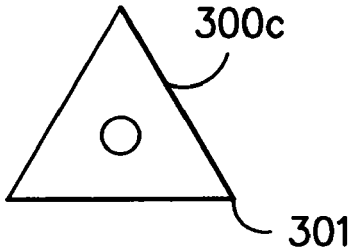
FIG. –3C–
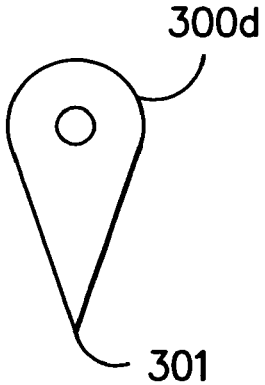
FIG. –3D–

*FIG. —9—*

APPARATUS AND METHOD FOR INCREASING THE AIR PERMEABILITY OF A TEXTILE WEB

BACKGROUND

The present invention generally relates to apparatuses and methods for increasing air permeability of fabrics, and in particular, to apparatuses and methods using a combination of fabric tension and mechanical treatment, and the fabrics and products resulting from the apparatuses and methods.

The goal for some types of fabric applications, such as air bags, is to produce an uncoated highly constructed, dense and strong fabric, but keep the air permeability at a desired level. For example, a waterjet woven fabric at a desired construction may have air permeability lower than a desired value when tested directly after weaving. To bring the permeability within a desired performance, the fabric can be subjected to at least one finishing process.

Heat setting has been used as a finishing process to increase air permeability, and is relatively expensive. An example of heat setting may be found in U.S. Pat. No. 5,581,856 (Krummheuer et al) which describes a technique that requires the use of a tenter dryer, or some other type of oven to be used to subject the fabric to elevated levels of heat. This oven equipment, along with the means to unroll, drive, and re-roll the fabric requires substantial costs in equipment, energy, and manpower increasing the cost to make the textile. Other methods of heat setting can make use of surface contact cans in place of an oven.

Stationary breaker bars have been used in a finishing process to soften fabric and are described in U.S. Pat. Nos. 5,966,785 and 6,195,854. The breaker bars do increase the softness of the fabric, but have the disadvantage that when multiple edges are used, the tension drag on each edge is accumulative and may increase beyond a desirable value. This increase in tension from many breaker bars in series may cause difficulty in the downstream roll-up drive and the continual rise in tension tends to heavily skew treatment onto the final breaker bar. Furthermore, it is difficult to change the number of times a fabric is rubbed by the breaker bars without running the fabric through the system multiple times or changing out the number of breaker bars in the system, both of which are costly options.

Therefore, there is a need for a process and an apparatus to increase the air permeability of a textile web a variable set amount while maintaining the textile strength and weight. There is also a need to produce uncoated airbag fabric, and the airbags made from such fabric, without the use of costly post loom heat treatment finishing processes.

BRIEF DESCRIPTION OF THE DRAWINGS

An embodiment of the present invention will now be described by way of example, with reference to the accompanying drawings.

FIGS. 3A-D are side end view drawings of different embodiments of the treatment body;

DETAILED DESCRIPTION

Figure 1:
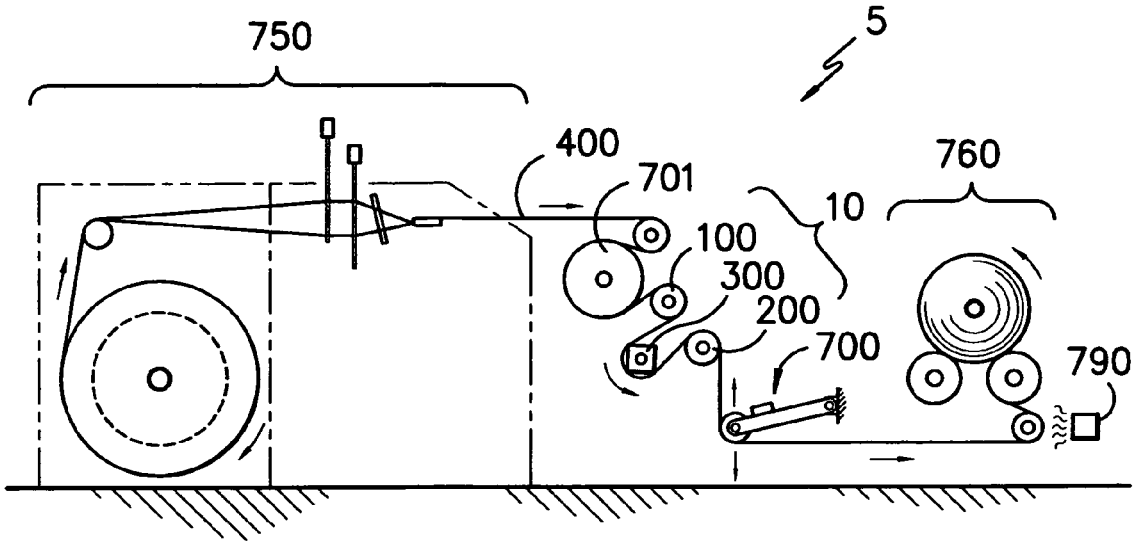
FIG. 1 is a schematic of one embodiment of a textile loom comprising the treatment apparatus of the invention.

Referring to FIG. 1, there is shown a textile loom 5 (such as a water jet loom) incorporating the textile forming apparatus 750, the treatment apparatus 10, and the main windup section 760. As illustrated, the treatment apparatus 10 is located after the textile is formed in the textile forming section 750 and after the main drive roll 701, but before the main windup section 760. Having the treatment apparatus 10 incorporated into the textile loom 5 simplifies the process from 2 manufacturing operations into 1 manufacturing operation reducing the cost of the finished textile web as the textile web 400 can be formed and have the air permeability increased in one pass through a machine. However, other configurations are possible.

The treatment apparatus 10 can be either installed directly in the textile loom 5 as shown, or can be incorporated into a relatively simple piece of stand alone equipment. If the former is chosen, then very little investment would be required, and no increase in manpower would be needed. If the latter application mode is chosen, the investment, energy costs, and supporting man power would be only a fraction of that needed for a conventional tenter/oven/heat set range.

As a stand alone piece of equipment, an unwind roller can be used to supply the textile web to the treatment apparatus 10 and a windup roller can be used to collect the treated textile web from the treatment apparatus 10. The stand alone piece of equipment would be very versatile, being able to treat a wide variety of textile webs. The stand alone piece of equipment will also have a way to control the tension in the web and may have other rollers or other pieces of equipment to control the textile web or perform different operations on the textile web.

Figure 2:
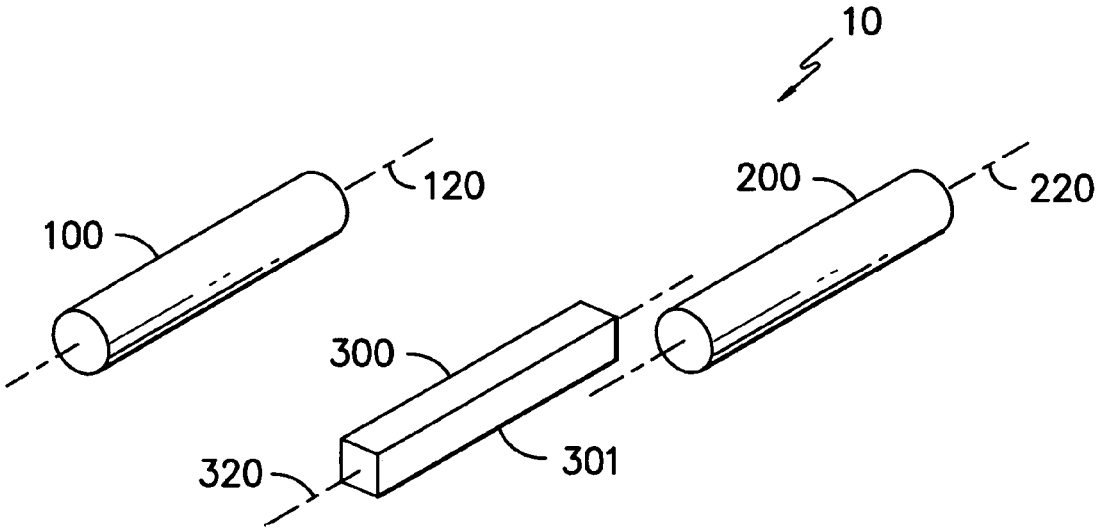
FIG. 2 is a schematic of one embodiment of the treatment apparatus.
Figure 5A:
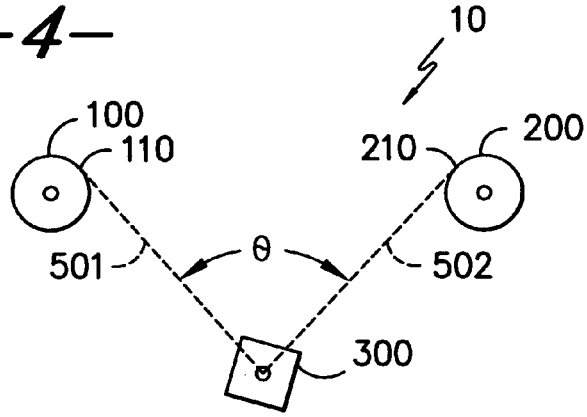
FIGS. 5A-C are schematics of different configurations of the treatment apparatus and the included angle.
Figure 5B:
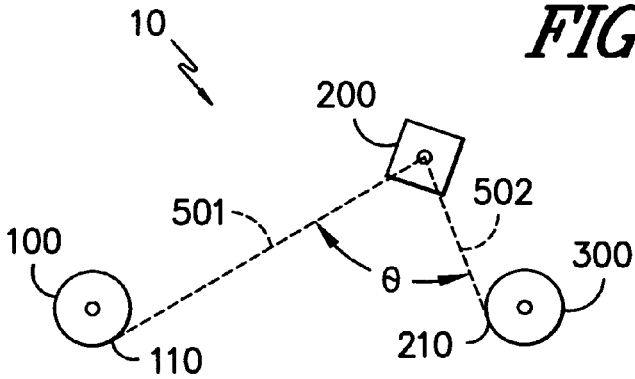
Figure 5C:
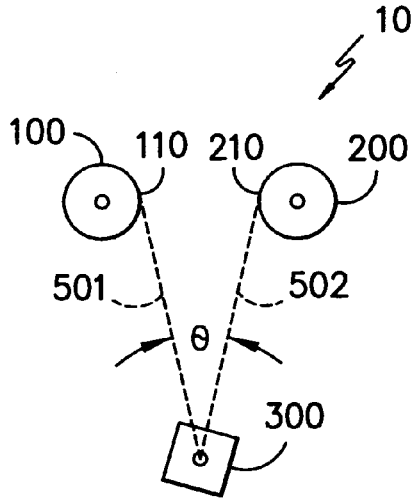
Figure 6:
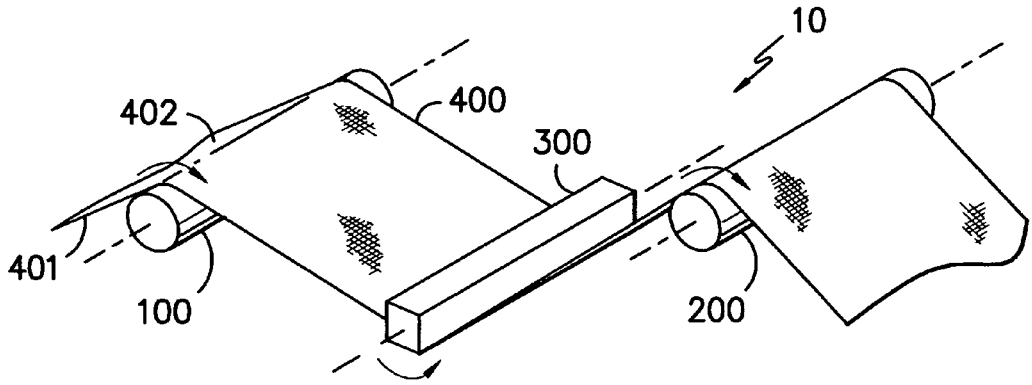
FIG. 6 is a schematic of one embodiment of the treatment apparatus with the textile web threaded through the treatment apparatus.

Referring now to FIGS. 2 and 6, is illustrated an embodiment of the treatment apparatus 10. The treatment apparatus 10 generally includes a first guide 100, a rotatable treatment body 300, and a second guide 200. FIGS. 5A-5C show the first guide 100 having a first guide surface 110 that guides the textile web from the first guide 100 to the treatment body 300. The second guide 200 has a second guide surface 210 that guides the textile web from the treatment body 300 to the second guide 200. The treatment body 300 has a treatment body axis 320. The external surface of the treatment body 300 has at least one longitudinal edge 301 substantially parallel to the treatment body axis 320.

The first guide surface 110 is the last surface that the textile web 400 contacts before the treatment body 300, and the second guide surface 210 is the first surface that the textile web 400 contacts after the treatment body 300. The first and second guides 100, 200 may be of any form that guides the textile web 400 to and from the treatment body 300, including, but not limited to a drive roller, an idle roller, a stationary roller, a cylinder, the textile, a bar, or a wire.

Preferably, the first guide 100 is a first guide roller and the second guide 200 is a second guide roller. In the embodiment where the first and second guides 100, 200 are rollers, the first and second guide surfaces 110, 210, will be in a certain location relative the first and second guide axis 120, 200, even through the actual external surface of the guides are different as the guides rotate. In the embodiment where the first and second guides 100, 200 are rollers, the first and second guides 100, 200 have a first and second axis 120, 220, respectively, that are substantially parallel to the treatment body axis 320.

Figure 8:
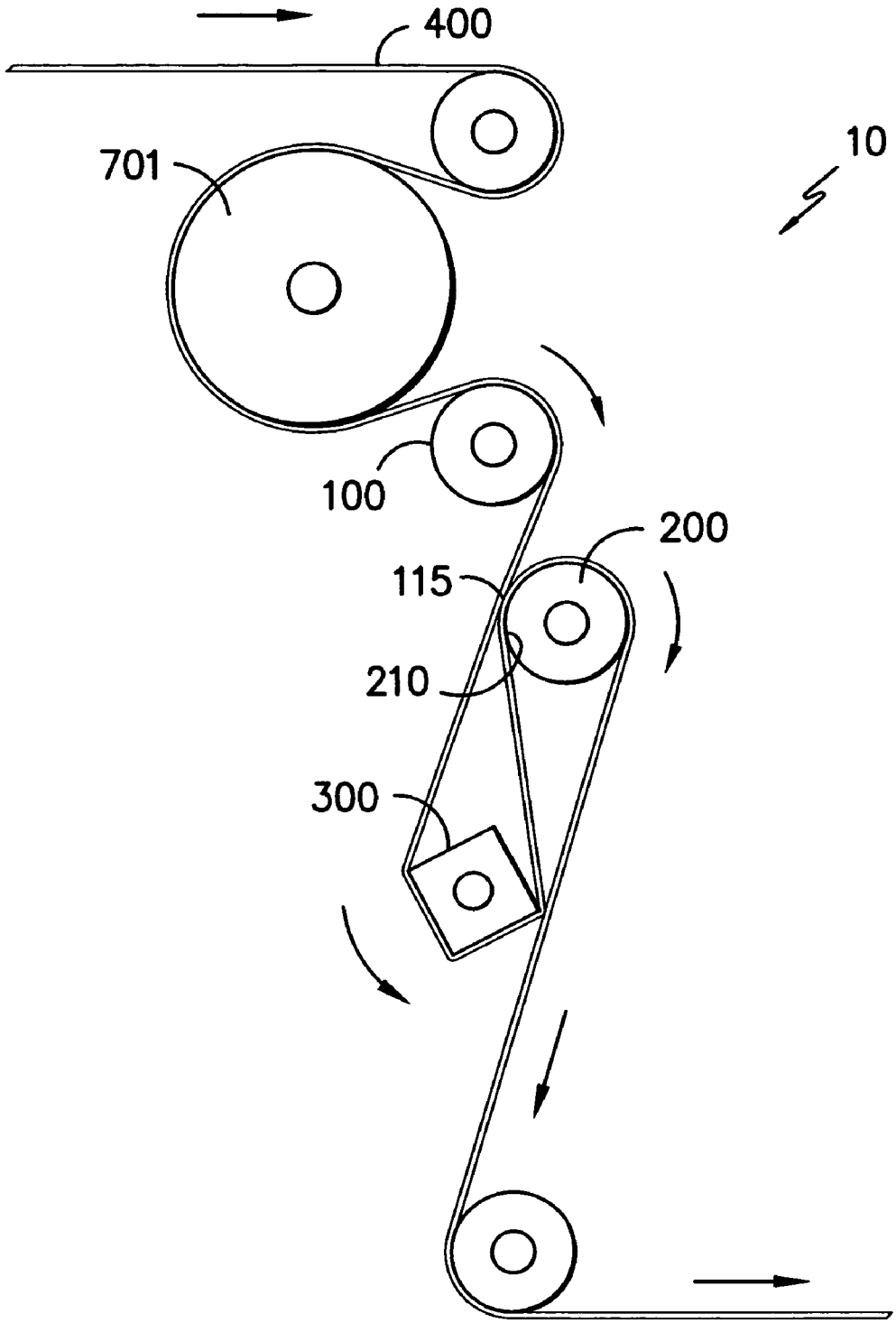
FIG. 8 is a side view of one embodiment of the treatment apparatus.

FIG. 8 shows a side view of another embodiment of the treatment apparatus 10. The first guide surface 110 is formed by the surface 115 of the textile web 400 as the surface 115 of the textile web 400 is the last surface that the textile web contacts before the treatment body 300. The second guide surface 210 is formed by the second guide 200 in that it is the first surface that the textile web 400 contacts after the treatment body 300.

Referring now to FIGS. 3A-D, there are illustrated cross-sectional views of the treatment body 300 with different possible configurations.

FIG. 3A illustrates the cross-sectional view of a 4 edged body 300*a*, FIG. 3B illustrates the cross-sectional view of a 2 edged shaped body 300*b*, FIG. 3C illustrates the cross-sectional view of a 3 edged shaped body 300*c*, and FIG. 3D illustrates the cross-sectional view of a 1 edged tear-shaped body 300*d*. Preferably, the treatment body has 2 to 4 edges, but is not limited to these ranges, and may have up to 18 or more edges on the body. The edges 301 may be substantially the same width or greater width as the textile web 400. In another embodiment, the edges 301 are smaller in width than the textile web 400. In this embodiment, the treatment body 300 may have multiple edges 301 along the width of the textile web 400 at the same circumferential location on the treatment body 300.

Figure 4:
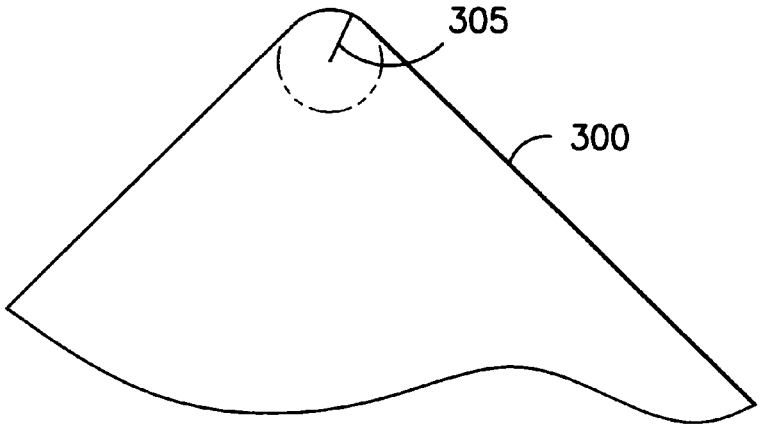
FIG. 4 is a side end view drawing of one edge of the treatment body illustrating the radius of curvature.

Referring now to FIG. 4, there is shown an enlarged end view of the treatment body 300, illustrating the edge 301. As illustrated, the edge 301 of the treatment body 300 has a radius of curvature 305. The edge 301 of the treatment body 300 preferably has a radius of curvature 305 of less than 0.25 inches (0.64 cm). The sharper (smaller the radius of curvature) the edge 301 is, the more the edge 301 will cause an increase of air permeability in the textile web 400. However, the sharper the edge 301, the faster the edge 301 will typically wear. In one embodiment, the radius of curvature is between 0.001 and 0.050 inches. This range has been found to increase the air permeability of the textile web 400, while having longevity.

Preferably, the treatment body 300 is rigid, meaning that it does not deform or bend in any significant amount in use with the textile web 400 in the treatment apparatus 10. The edge 301 of the treatment body 300 can be hardened or treated such to reduce wear caused by the constant friction of the textile web 400. The edges 301 of the treatment body 300 may additionally have one or more coatings. There are a number of coatings and surface treatments well known to increase hardness and wear resistance. These include titanium nitride (TiN) coatings, tungsten carbide, ceramics, diamond or graphite based coatings, nitriding, chrome plating, and anodizing. TiN is preferred in a thickness of a few microns because it does not change surface geometry, i.e. the radius of the edge.

FIGS. 5A-C shows the included angle θ in various configurations of the treatment apparatus 10. The included angle θ is defined to be the internal angle formed between a first imaginary plane 501 running from first guide surface 110 to the treatment body axis 320 and a second imaginary plane 502 running between the second guide surface 210 and the treatment body axis 320. FIGS. 3A-C illustrate a number of different configurations of the treatment apparatus 10 and the resulting included angle θ. The included angle θ is at least 0 degrees and less than about 160 degrees. In one embodiment, the included angle θ is at least 0 degrees and less than 5 degrees, more preferably at least 0 degrees and less than 2 degrees. In another embodiment, the included angle is from about 20 to 90 degrees. An included angle of about 20-30 degrees results in a setup where the actual path of the textile web through the treatment apparatus 10 deflects around the treatment body 300 such that the path resemble a U-shape. This range has been shown to produce textile webs 400 with increased air permeability and with good productivity for the treatment apparatus 10.

FIG. 6 illustrates a method of threading the textile web 400 onto one embodiment of the treatment apparatus 10. The textile web 400 has a first side 401 and a second side 402. In the embodiment shown in FIG. 6, the first side 401 of the textile web 400 passes across the first guide roller 100 in contact with the external surface of the first guide 100. Next, the second side 402 of the textile web 400 passes around a portion of the rotating treatment body 300 in contact with the exterior surface of the treatment body 300. Then, the first side 401 of the textile web 400 then passes across the second guide 200 in contact with the external surface of the second guide 200. In other embodiments the textile web may be threaded through the treatment apparatus 10 such that different sides of the textile web 400 passes across the guides 100, 200 and treatment body 300. In one example, the textile web 400 may pass across the first guide 100 and the treatment body 300 on the first side 401, and the second guide 200 on the textile web second side 402.

FIG. 6 also shows the different relative directions that the textile web 400 may take in relation to the treatment body 300. In one embodiment, exterior surface of the treatment body 300 moves in the same direction as the moving textile web 400. In this embodiment, the exterior surface of the treatment body 300 preferably moves at a different speed than the textile web 400 travels. In another embodiment, the exterior surface of the treatment body 300 moves in the opposite direction to the textile web 400.

The first guide surface 110, the second guide surface 210, and the treatment body axis 320 are substantially parallel and the textile web 400 passes across each in contact in a direction substantially perpendicular to the axis of the rollers and treatment body. Preferably, the treatment body 300 is at least as wide as the textile web 400. Optionally, additional treatment apparatuses 10 may be added to the textile manufacturing line 5 or a stand alone piece of equipment to increase the air permeability change in the textile web 400.

Figure 7:
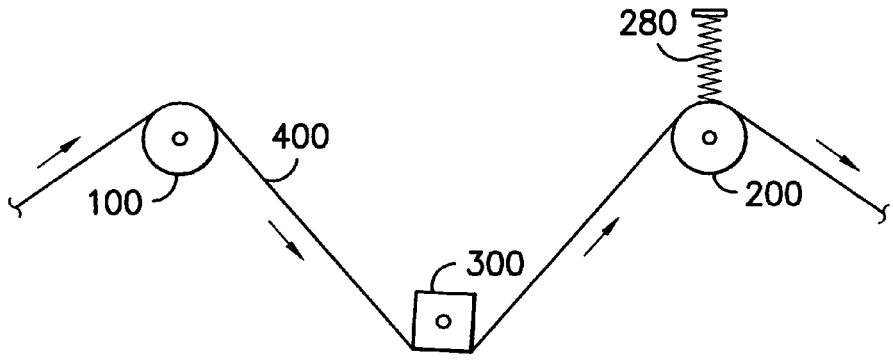
FIG. 7 is a schematic of one embodiment of the invention where the second guide roller controls the tension in the textile web.

Referring now to FIG. 7, there is shown the treatment apparatus 10 with the second guide roller 200 serving to control the tension in the textile web 400 by means of a spring 280 attached to the second guide roller 200. In another embodiment shown in FIG. 1, a variable length tensioning unit 700 controls the tension in the textile web 400. The variable length tensioning unit is a pivoting dancer roller that adjusts the speed of the roll up device to keep the position of the dancer roller fixed or constant. This maintains the tension of the textile web 400 as a function of the adjustable weight on the dancer roller. This pivoting roller adjusts the length of the textile web 400 to adjust tension in the textile web 400. Optionally, an electronic load cell may be used to adjust tension in the textile web 400. Tension may be controlled in the textile web 400 by any other known method such as a variable speed uptake. Additionally, the textile loom 5 may have an IR heater 790 located before the roll up device to remove any residual moisture in the textile web 400.

The textile web 400 may be any textile, including, but not limited to woven, nonwoven, or knit textiles. Woven fabrics are preferred and may be plain weaves, twills or other well-known constructions. Examples of knit fabrics include double knits, jerseys, interlock knits, tricots, warp knit fabrics, weft insertion fabrics, etc, with the effect being most effective on a knit that has less stretch in the machine direction. Such fabrics may be constructed from spun or filament yarns or may be constructed by using both types of yarns in the same fabric. The textile may be of any suitable material, including, but not limited to, polyamide, polyester, polypropylene, aramid. In one embodiment, a woven, nylon textile is used which is a commonly used textile for airbags. Such textiles can be especially useful and economical if they can be used directly from the loom without subsequent costly heat treatment or heat setting process.

The invention generally comprises a treatment apparatus and method of pulling a textile web under tension across a rotating treatment body with an angled, or radiused edge. This motion of bending and "rubbing" of the fabric is believed to slightly disrupt the "orderliness" and nesting of the individual fibers or yarns in the weave structure, thus allowing increased passage of air. Some of the variables that can influence the degree of permeability increase can include the sharpness of the edge, the angle of the bend, the tension of the fabric, and the number of edges to which the textile web is exposed.

The invention with the rotating treatment body has numerous advantages over the previous systems. The invention occupies less space in a situation where the effect of many edges is required and tension does not increase going to the windup area in a machine. Furthermore, the degree of effect can be easily manipulated by varying the parameters including relative rotational speed of the rotating treatment body in relation to the speed of the fabric passing over it to subject any give point in the fabric to more or less edge passes (bends or rubs).

The process for increasing the air permeability of a textile web 400 comprises in order:

1) passing the textile web 400 across a first guide 100 including a first guide surface 110 for directing the textile web 400 towards a treatment body 300.

2) rotating the treatment body 300 about a treatment body axis 320, and moving the textile web 400 from the first guide surface 110 in tension around a portion of the treatment body 300 and in contact with the exterior surface of the treatment body 300, wherein the exterior surface of the treatment body 300 includes at least one longitudinal edge 301 substantially parallel to the treatment body axis 320.

3) passing the textile web 400 across a second guide 200 including a second guide surface 210 for directing the textile web 400 from the treatment body 300, wherein the included angle θ between a first plane 501 running from the first guide surface 110 to a treatment body axis and a second plane 502 running between the second guide surface 210 and the treatment body axis 320 is greater than zero degrees and less than about 160 degrees. The first and second guides 100, 200 may be of any form that guides the textile web 400 to and from the treatment body 300, such as a driven roller, an idle roller, a stationary roller, a cylinder, a bar, or a wire. Preferably, the first guide 100 is a first guide roller and the second guide 200 is a second guide roller.

During the process, heat and/or moisture may be added to the textile web 400 to further enhance the increase in air permeability. The textile web 400 may be introduced into the treatment apparatus 10 pre-heated or at ambient temperature, wet or dry. Introducing the textile web 400 to the treatment body in a wet condition may change the friction properties between the treatment body 300 and the textile web 400 slightly.

In one embodiment, the textile web 400 passes through the treatment apparatus 10 and the rotating treatment body 300 rotates such that, as the textile web 400 moves around the exterior of the treatment body 300, the textile web 400 experiences an average of between 2 to 10 edge passes by the edges 301. The number of exposures of textile web 400 to edges 301 is a function of the ratio of exterior surface speed of the treatment body 300 versus speed of the textile web 400, the number of edges 301 on the treatment body 300, and how much the textile web 400 wraps around the treatment body 300.

The amount of increase in air permeability of the textile web 400 depends on many factors including the construction of the textile, the configuration of the treatment apparatus 10, and the operating parameters and can be tailored to achieve the desired results. In one embodiment, the air permeability is increased by 10 to 500%. This range has been found to increase the air permeability of some woven textiles for use in applications such as air bags. The treatment apparatus 10 can also impart increased air permeability and softening to the fabric without degradation or loss of strength of the fabric. Additionally, the textile web 400 moving around the exterior of the treatment body under tension causes the stiffness of the textile fabric to decrease by 1 to 100%, more preferably 2 to 30% as measured by ASTM D4032.

The tension on the textile web 400 as it passes through the treatment apparatus 10 affects the amount that the air permeability of the textile increases. In one embodiment, the textile web 400 has a tension of between 1 and 10 pounds per linear inch as it moves around the exterior of the treatment body 300. It has been found that this range produces textiles with increased air permeability and is easily added to an existing piece of equipment, such as a textile loom. To ensure a functional product, it is preferred for the tension in the textile web 400 to be less than 80% of the yield strength of the textile web 400. In one embodiment, the tension in the textile web 400 is maintained at a substantially constant tension. Having a relatively constant tension in the textile web 400 ensures even treatment of the textile web 400 by the treatment body 300.

Figure 10:
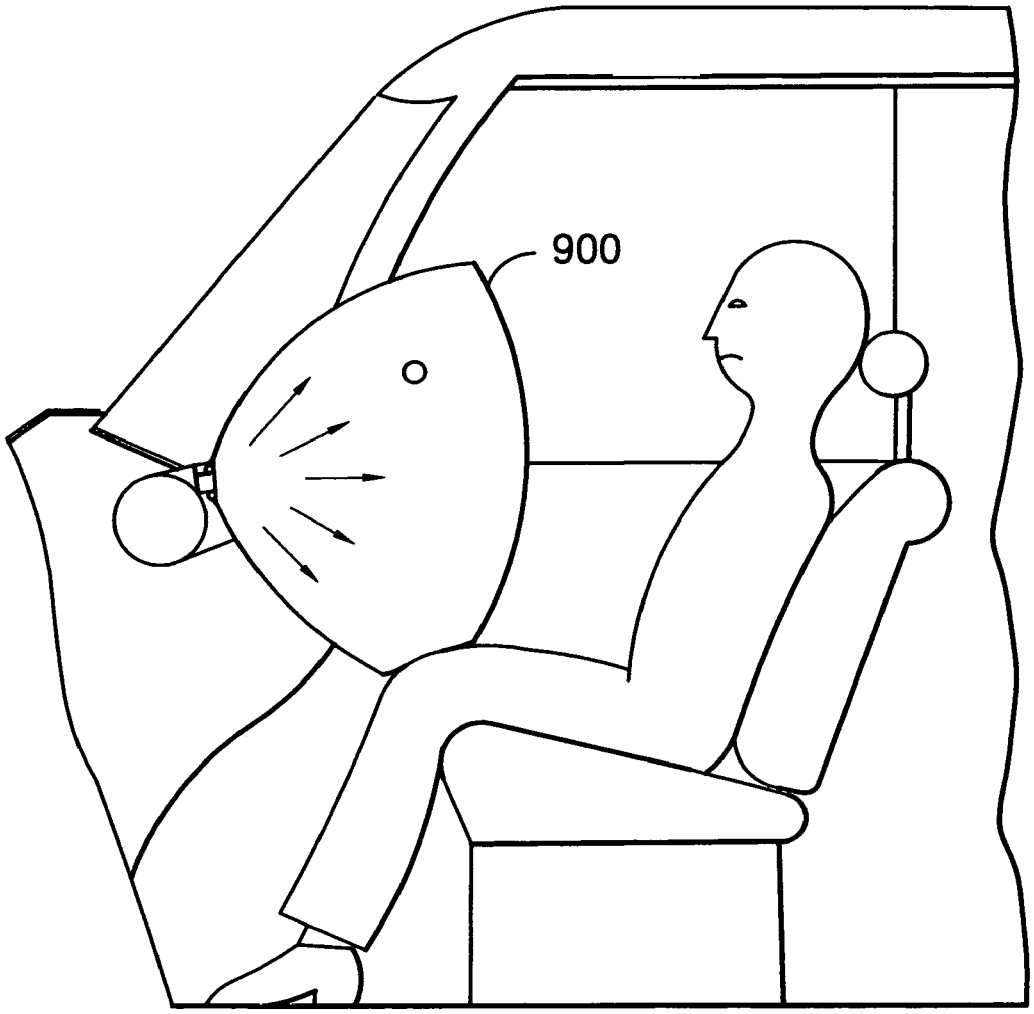
FIG. 10 is a schematic of an airbag made with the treated textile web.

The textile web 400 produced by the textile loom 5 is useful in airbag constructions as shown as airbag 900 in FIG. 10. The main elements of an airbag system are: an impact sensing system, an ignition system, a propellant material, an attachment device, a system enclosure, and an airbag. Upon sensing an impact, the propellant is ignited causing an explosive release of gases filling the airbag 900 to a deployed state which can absorb the impact of the forward movement of a body and dissipate its energy by means of rapid venting of the gas. The airbag 900 comprises the uncoated textile web 400. The textile web 400 is made from nominal 630 denier nylon yarns in a plain weave construction with 41 ends per inch and 41 picks per inch. The textile web 400 is made on a water jet textile loom and subjected to the treatment apparatus 10 either as a part of the textile loom 5, or as a separate processing step. The textile web 400 does not have heat added post water jet loom meaning that once the textile web 400 is wound up on the main wind up section 760, there is no additional heat added. There may be heaters or dryers, such as the IR heater 790 before the textile web 400 is wound up. The resulting textile web 400 has a dynamic air permeability of at least 800 mm/sec as measured by ASTM D6476, more preferably at least 900 mm/sec. In one embodiment, the textile web 400 has circular bend stiffness less than approximately 2.7 pounds.

EXAMPLES

Figure 9:
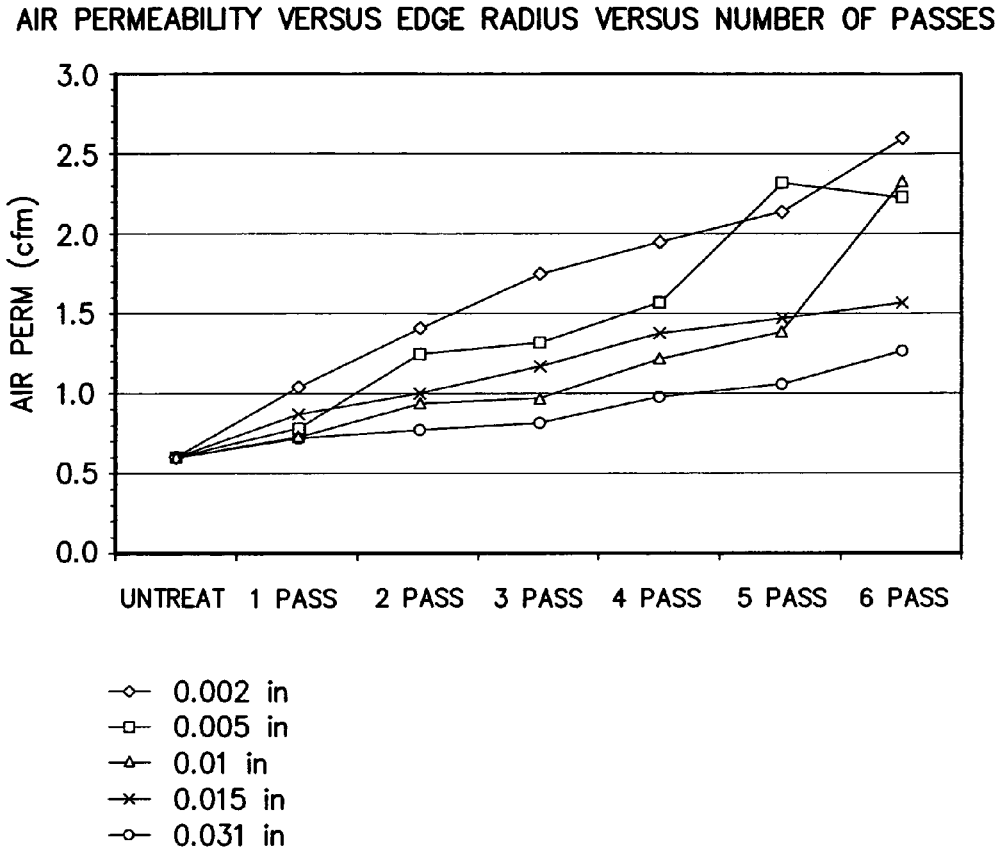
FIG. 9 is a graph of air permeability change versus the edge radius of the treatment body versus the number of passes the textile receives.

FIG. 9 shows the air permeability change versus the edge radius of the treatment body versus the number of passes the textile receives. The fabric used in the test shown in FIG. 9 was a 630 denier, Type 728 nylon 6, 6 yarn from Invista® that was water jet loom woven with 41 ends per inch and 41 picks per inch. Air permeability was tested according to ASTM D-737. Dynamic Air Permeability was tested according to ASTM D6476 at 30–70 kPa. As one can see from FIG. 9, air permeability was increased from a small percentage to over 400% and the amount of air permeability can be controlled to obtain the desired amount of air permeability for a given textile. The sharper the edge and the more times a textile is passed over the edge, the larger the increase in air permeability.

Next, control examples C1-C4 and invention examples I1-I4 were tested in a manufacturing setup with the treatment body 300 and treatment apparatus 10 as part of a textile loom. Each of the examples were woven on a water jet loom with 41 ends per inch and 41 picks per inch. Control examples C1 and C2 were woven from 630 denier Type 446 nylon 6-6 yarns from PHP®. Control example C3 was woven from a 630 denier Type 728 nylon 6-6 yarn from Invista® and C4 was woven from a 630 denier Type A74 nylon 6-6 yarn from Solutia®. Control examples C1-C4 were not subjected to the treatment body of the invention.

Invention example I1 was run at the same processing conditions as example C1 except the textile web experienced an average of 6.1 edge passes. Invention examples I2, I3, and I4 were run at the same processing conditions as C2, except the textile web was passed over a treatment body for different average numbers of edge passes and edge sharpness. The data shown in Table 1 below shows the different conditions the textile web was subjected to and the resulting air permeability and stiffness of the textile.

The control examples C1-C4 woven by a water jet loom with 41 ends per inch and 41 picks per inch with 630 denier nylon yarns had a dynamic air permeability of between 567 to 732.

From the invention examples compared to the control examples the dynamic air permeability increased from about 30 to 64% and the stiffness decreased 4 to 28%. As one can see from the data, number of edge passes, tension, sharpness of the edges can be tailored to obtain the desired air permeability and softness of the final textile product.

The invention has been described in detail with particular reference to certain preferred embodiments thereof, but it will be understood that variations and modifications can be effected within the spirit and scope of the invention.

What is claimed is:

1. A treatment apparatus for increasing the air permeability of a textile web comprising:

a rotating treatment body having a treatment body axis, wherein the exterior of the treatment body includes at least one longitudinal edge substantially parallel to the treatment body axis;

a first guide having a first guide surface for directing the textile web to the treatment body;

a second guide having a second guide surface for directing the textile web from the treatment body;

wherein the included angle between a first plane running from the first guide surface to the treatment body axis and a second plane running between the second guide surface and the treatment body axis is at least zero degrees and less than about 5 degrees.

2. The treatment apparatus of claim 1, wherein the first guide comprises a first guide roller having a first guide roller axis and the second guide comprises a second guide roller having a second guide axis.

3. The treatment apparatus of claim 2, wherein the first guide roller axis, the second guide roller axis, and the treatment body axis are substantially parallel.

4. The treatment apparatus of claim 2, wherein the textile web has a first side and a second side and the textile web passes across the first guide roller and second guide roller on the first side of the textile web and textile web passes across the treatment body on the second side of the textile web.

TABLE 1

Physical properties of treated and control textiles

| | C1 | C2 | C3 | C4 | I1 | I2 | I3 | I4 |
|---|---|---|---|---|---|---|---|---|
| Edge Radius (inches) | n/a | n/a | n/a | n/a | 0.015 | 0.010 | 0.005 | 0.005 |
| Average # of edge passes | 0 | 0 | 0 | 0 | 6.1 | 2.5 | 2.5 | 6.1 |
| Warp tension (weight in lbs) | 65 | 60 | | | 65 | 60 | 60 | 60 |
| Compensator weight (in lbs on the pivoting dancer roll) | 190 | 190 | 220 | 220 | 190 | 190 | 190 | 190 |
| Tension on textile (lbs per linear inch) | 2.4 | 2.4 | 2.8 | 2.81 | 2.4 | 2.4 | 2.4 | 2.4 |
| Avg. Air Perm at 124 Pa (CFM) | 0.44 | 0.5 | 0.69 | 0.88 | 0.83 | 0.58 | 0.69 | 0.97 |
| Avg. Dynamic Air Perm 30-70 kPa (mm/sec) | 567 | 574 | 731 | 732 | 833 | 773 | 745 | 943 |
| % Increase in Dynamic Air Perm | | | | | 47% | 35% | 30% | 64% |
| Stiffness, Circular bend test ASTM D4032 in lbs | 2.76 | 2.95 | 3.16 | 2.87 | 2.65 | 2.42 | 2.12 | 2.40 |
| % reduction in stiffness | | | | | 4% | 18% | 28% | 19% |

5. The treatment apparatus of claim 4, wherein the exterior surface of the treatment body moves at a different speed than the textile web.

6. The treatment apparatus of claim 1, wherein the rotating treatment body rotates in a direction where the exterior surface of the treatment body moves in the same direction as the textile web.

7. The treatment apparatus of claim 1, wherein the rotating treatment body rotates in a direction where the exterior surface of the treatment body moves in the opposite direction as the textile web.

8. The treatment apparatus of claim 1, wherein the at least one longitudinal edge of the treatment body has a length at least as wide as the textile web.

9. The treatment apparatus of claim 1, wherein the rotating treatment body comprises 2 to 4 longitudinal edges substantially parallel to the treatment body axis.

10. The treatment apparatus of claim 1, wherein the edges of the rotating treatment body have a radius of curvature of between 0.001 and 0.050 inches.

11. The treatment apparatus of claim 1, further comprising an unwind roller and a windup roller.

12. The treatment apparatus of claim 11, wherein the treatment apparatus is incorporated into a free standing machine.

13. The treatment apparatus of claim 1, wherein the treatment apparatus is incorporated into a textile loom.

14. The treatment apparatus of claim 1, wherein the second guide controls the tension in the textile web.

15. The treatment apparatus of claim 1, further comprising a variable length tensioning unit.

16. The treatment apparatus of claim 1, wherein the rotating treatment body is rigid.

17. A process for increasing the air permeability of an airbag fabric comprising in order:

passing the airbag fabric across a first guide having a first guide surface directing the airbag fabric to the treatment body;

rotating a treatment body about a treatment body axis, and moving the airbag fabric from the first guide surface in tension around a portion of the treatment body and in contact with the exterior surface of the treatment body, in a direction substantially perpendicular to the treatment body axis, wherein the exterior surface of the treatment body includes at least one longitudinal edge substantially parallel to the treatment body axis;

passing the airbag fabric across a second guide having a second guide surface directing the airbag fabric from the treatment body;

wherein the included angle between a first plane running from the first guide surface to the treatment body axis and a second plane running between the second guide surface and the treatment body axis is at least zero degrees and less than about 160 degrees, wherein the step of rotating the treatment body and moving the airbag fabric around the exterior surface of the treatment body causes the air permeability of the airbag fabric to increase 10 to 500%.

18. The process of claim 17, wherein the first guide comprises a first guide roller having a first guide roller axis and the second guide comprises a second guide roller having a second guide axis.

19. The process of claim 18, wherein the wherein the first guide roller axis, the second guide roller axis, and the treatment body axis are substantially parallel.

20. The process of claim 18, wherein the airbag fabric moves in contact with the first guide roller and substantially perpendicular to the first guide roller axis, and wherein the airbag fabric moves in contact with the second guide roller and substantially perpendicular to the second guide roller axis.

21. The process of claim 18, wherein the airbag fabric has a first side and a second side and the airbag fabric passes across the first guide roller and second guide roller on the first side of the airbag fabric and airbag fabric passes across the treatment body on the second side of the airbag fabric.

22. The process of claim 17, wherein the included angle is greater than 0 and less than about 90 degrees.

23. The process of claim 22, wherein the included angle is greater than 0 and less than about 5 degrees.

24. The process of claim 17, wherein the step of rotating the treatment body and moving the airbag fabric includes rotating the treatment body in a direction where the exterior surface of the treatment body moves in the same direction as the airbag fabric.

25. The process of claim 24, wherein the step of rotating the treatment body and moving the airbag fabric includes rotating the treatment body in a direction where the exterior surface of the treatment body moves at a different speed than the airbag fabric.

26. The process of claim 17, wherein the step of rotating the treatment body and moving the airbag fabric includes rotating the treatment body in a direction where the exterior surface of the treatment body moves in the opposite direction as the airbag fabric.

27. The process of claim 17, wherein the exterior surface of the rotating treatment body comprises 2 to 4 longitudinal edges substantially parallel to the treatment body axis.

28. The process of claim 27, wherein each longitudinal edge has a length approximately equal to or greater than the width of the airbag fabric.

29. The process of claim 17, wherein the edges of the rotating treatment body have a radius of curvature of between 0.001 and 0.050 inches.

30. The process of claim 17, wherein the step of rotating the treatment body and moving the airbag fabric in tension around the treatment body includes the airbag fabric textile web being in a tension of between 1 and 10 pounds per linear inch.

31. The process of claim 17, wherein the step of rotating the treatment body and moving the airbag fabric around the exterior surface of the treatment body causes the airbag fabric to have an average of 2 to 10 edge passes.

32. The process of claim 17, further including the step of unwinding the airbag fabric from an unwind roller before the first guide and the step of winding the airbag fabric on a windup roller after the second guide.

33. The process of claim 17, wherein the step of rotating the treatment body and moving the airbag fabric in tension around the exterior surface of the treatment body further includes inducing tension in the airbag fabric by applying a force to the second guide.

34. The process of claim 17, wherein the step of rotating the treatment body and moving the airbag fabric around the exterior surface of the treatment body causes the stiffness of the airbag fabric to decrease by 2 to 30%.

35. A treatment apparatus for increasing the air permeability of a textile web comprising:

a rotating treatment body having a treatment body axis, wherein the exterior of the treatment body includes at least one longitudinal edge substantially parallel to the treatment body axis;

a first guide having a first guide surface for directing the textile web to the treatment body;

a second guide having a second guide surface for directing the textile web from the treatment body;

wherein the included angle between a first plane running from the first guide surface to the treatment body axis and a second plane running between the second guide surface and the treatment body axis is at least zero degrees and less than about 160 degrees wherein the edges of the rotating treatment body have a radius of curvature of between 0.001 and 0.050 inches.

36. The treatment apparatus of claim 35, wherein the included angle is greater than 0 and less than to about 90 degrees.

37. The treatment apparatus of claim 35, wherein the included angle is greater than 0 and less than about 5 degrees.

38. A process for increasing the air permeability of a textile web, wherein the textile web comprises a plain weave fabric, comprising in order:

passing the plain weave fabric across a first guide having a first guide surface directing the plain weave fabric to the treatment body;

rotating a treatment body about a treatment body axis, and moving the plain weave fabric from the first guide surface in tension around a portion of the treatment body and in contact with the exterior surface of the treatment body, in a direction substantially perpendicular to the treatment body axis, wherein the exterior surface of the treatment body includes at least one longitudinal edge substantially parallel to the treatment body axis;

passing the plain weave fabric across a second guide having a second guide surface directing the plain weave fabric from the treatment body;

wherein the included angle between a first plane running from the first guide surface to the treatment body axis and a second plane running between the second guide surface and the treatment body axis is at least zero degrees and less than about 160 degrees.

39. The process of claim 38, wherein the edges of the rotating treatment body have a radius of curvature of between 0.001 and 0.050 inches.

40. The process of claim 38, wherein the step of rotating the treatment body and moving the lain weave fabric around the exterior surface of the treatment body causes the air permeability of the plain weave fabric to increase 10 to 500%.

* * * * *

UNITED STATES PATENT AND TRADEMARK OFFICE

CERTIFICATE OF CORRECTION

PATENT NO. : 7,296,328 B1
APPLICATION NO. : 11/477039
DATED : November 20, 2007
INVENTOR(S) : Petri et al.

It is certified that error appears in the above-identified patent and that said Letters Patent is hereby corrected as shown below:

In column 10, line 40, after the word “fabric” delete the word “textile”.

In column 10, line 41, before the word “being” delete the word “web”.

In column 11, line 11, after the word “than” delete the word “to”.

In column 12, line 19, after the word “the” delete the word “lain” and replace with the word -- plain --.

Signed and Sealed this

Twenty-ninth Day of April, 2008

JON W. DUDAS
*Director of the United States Patent and Trademark Office*